US006791275B2

(12) United States Patent
Shackle

(10) Patent No.: US 6,791,275 B2
(45) Date of Patent: Sep. 14, 2004

(54) LOW PRESSURE GAS DISCHARGE LAMP BALLAST WITH ON-OFF INDICATOR

(75) Inventor: Peter W. Shackle, Madison, AL (US)

(73) Assignee: Robertson Worldwide, Inc., Blue Island, IL (US)

( * ) Notice: Subject to any disclaimer, the term of this patent is extended or adjusted under 35 U.S.C. 154(b) by 71 days.

(21) Appl. No.: 10/212,605

(22) Filed: Aug. 5, 2002

(65) Prior Publication Data

US 2004/0021429 A1 Feb. 5, 2004

(51) Int. Cl.[7] ..... H05B 41/14
(52) U.S. Cl. ..... 315/129; 315/119
(58) Field of Search ..... 315/119, 224, 315/225, 294, 307, 120, 123, 125, 126, 127, 128, 209 R, 291, 219, 244, 129–136

(56) References Cited

U.S. PATENT DOCUMENTS 5,442,257 A * 8/1995 Mitsumoto ..... 315/129
5,952,832 A * 9/1999 Stevanovic et al. ..... 315/107
6,366,032 B1 4/2002 Allison et al.
6,545,432 B2 * 4/2003 Konopka ..... 315/291

* cited by examiner

*Primary Examiner*—Wilson Lee
(74) *Attorney, Agent, or Firm*—Charles E. Bruzga

(57) ABSTRACT

A ballast for a low pressure gas discharge lamp, preferably of the heated-filament type, includes an on-off indicator for a lamp. The ballast includes a load circuit with a lamp, and a driver for supplying AC load current to the lamp. Such driver includes circuitry for shutting off the load current in the presence of a lamp fault condition. The ballast also includes a pair of nodes having voltage across them when the lamp operates normally, and having substantially no voltage across them when the lamp is off. An on-off lamp indicator circuit includes a light-emitting device and is coupled to the pair of nodes for causing the light-emitting device to emit light when the driver supplies load current to the lamp and for causing the light-emitting device to cease to emit light when the driver no longer supplies load current to the lamp.

33 Claims, 7 Drawing Sheets

LOW PRESSURE GAS DISCHARGE LAMP BALLAST WITH ON-OFF INDICATOR

FIELD OF THE INVENTION

This invention relates to ballasts for ultraviolet (UV) or other gas discharge lamps that include an indicator of the on or off condition of the lamp. More particularly, the invention relates to ballasts including a pair of nodes that have voltage across them when a lamp operates normally, and that have substantially no voltage across them when the lamp is off. This condition typically occurs in ballasts that power lamps having heated filaments.

BACKGROUND OF THE INVENTION

Ultraviolet (UV) lamps are widely used for sterilization of water and air in water supplies, air ventilation systems and the like. UV lamps are quite similar to conventional low pressure discharge lamps, the principal difference being that there is no fluorescent coating on the inside of the lamp. Without a fluorescent coating, UV radiation from the plasma inside the lamp flows directly out of the lamp, but is almost imperceptible to the human eye. In particular, the human eye is very insensitive to UV radiation, and may perceive only a faint, dim glow even when the intensity is such that immediate damage to the eye and other parts of the body may occur. Consequently this kind of UV light is dangerous to people, and UV light sources are always kept completely enclosed, for instance, inside a water tank or air duct where they sterilize the water or air.

Faced with the foregoing safety concern, the otherwise routine issue of verifying that the lamp is still running becomes a somewhat complex problem. Verification is important because failure of a UV lamp to sterilize the air or water may have serious health consequences. It is not acceptable for a person to view the light source to verify its operation. Instead, it is customary to provide some kind of electrical sensing circuitry to indicate satisfactory operation of the lamp.

One prior art approach involves modifying a lamp ballast to include a resistor in series with a UV lamp. The voltage across the resistor is used to drive a bidirectional light-emitting diode (LED). When lamp current is flowing, a voltage generated across the resistor is used to drive the bidirectional LED. A problem with this technique is that it only works for instant-start ballasts, which have only one wire going to the lamp ends. Also, it has the property that the UV ballast has to be constructed quite differently from a conventional ballast for gas discharge lamps such as fluorescent lamps. For instance, the mentioned resistor needs to be interconnected within the ballast circuitry, and wires for the LED need to be connected from the ballast circuitry to a point outside the ballast.

Another technique to provide an indication of on-off UV lamp operation is to place a light pipe close to the UV lamp to receive UV energy, and then to place a fluorescent element at an external end of the light pipe that lights up from the UV energy impinging upon it. The use of light pipes with fluorescent elements is relatively expensive and undesirable for that reason.

It would be desirable to provide an on-off indicator signal for a UV lamp.

If would be further desirable to provide an on-off indicator for a UV lamp that may incorporate a mass-produced ballast used to power fluorescent lamps.

If would also be desirable to provide an on-off indicator signal for non-UV lamps that may be economically implemented.

SUMMARY OF THE INVENTION

In accordance with one embodiment of the invention, a ballast for a low pressure gas discharge lamp includes an on-off indicator for a lamp that preferably has heated filaments. Three examples of ballasts for lamps with heated filaments are: (1) a program start ballast, (2) a rapid start ballast, and (3) a controlled preheat ballast.

The ballast includes a load circuit with a lamp. The ballast further includes a driver for supplying AC load current to the lamp. Such driver includes circuitry for shutting off the load current in the presence of a lamp fault condition. The ballast also includes a pair of nodes that have voltage across them when the lamp operates normally, and that have substantially no voltage across them when the lamp is off. This condition typically occurs in ballasts for powering lamps that have heated filaments.

An on-off lamp indicator circuit includes a light-emitting device and is coupled to the pair of nodes for causing the light-emitting device to emit light when the driver supplies load current to the lamp and for causing the light-emitting device to cease to emit light when the driver no longer supplies load current to the lamp.

Beneficially, the ballast can be of the mass-produced type for powering conventional fluorescent lamps, such as that of U.S. Pat. No. 6,366,032, by Allison and Moore and which is assigned to the instant assignee. The ballast described in the foregoing patent automatically shuts off power to the lamp when a lamp fault is detected. In a preferred form, the on-off indicator circuit can be powered from available nodes across which voltage of a lamp filament is present, so that the ballast does not need to be changed mechanically.

The invention may be useful in connection with a conventional fluorescent lamp, to economically provide a remote confirmation of proper operation, for instance.

DETAILED DESCRIPTION OF THE INVENTION

Figure 1:
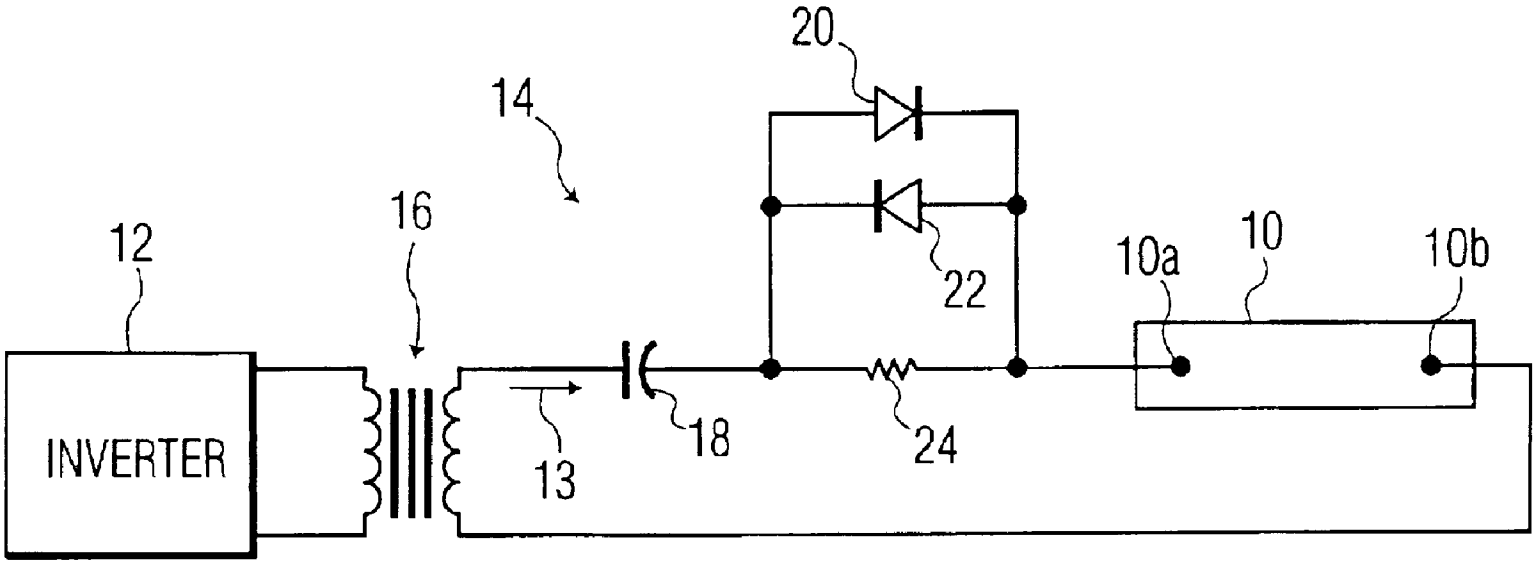
FIG. 1 PRIOR ART
FIG. 1 shows a schematic diagram, partially in block form, of a prior art circuit for providing an on-off indication of UV lamp operation.

The present invention will become clearer after considering the prior art approach of FIG. 1. In FIG. 1, an ultraviolet (UV) lamp 10 has electrodes 10*a* and 10*b* that are not provided with a filament for heating the electrodes. A conventional inverter circuit 12 supplies alternating current (AC) load current 13 for a load circuit 14 via a transformer 16. A capacitor 18 limits current through the lamp.

Bidirectional (or anti-parallel connected) light-emitting diodes (LEDs) 20 and 22 emit light when load current 13 flows through lamp 10. Thus, AC load current 13 creates an AC voltage drop across a resistor 24 when the lamp conducts current, and that voltage drop causes LEDs 20 and 22 to emit light, indicating that the lamp is operating. As mentioned above, the UV lamp itself emits UV light that is almost imperceptible to the human eye, so LEDs 20 and 22 give a visual indication to the human eye that the lamp is operating.

When load current 13 ceases to flow, the AC voltage drop across resistor 24 ceases, and the LEDs stop emitting light. The cessation of light from the LEDs visually indicates that the UV lamp has stopped operating, and so needs to be inspected or replaced.

Figure 2:
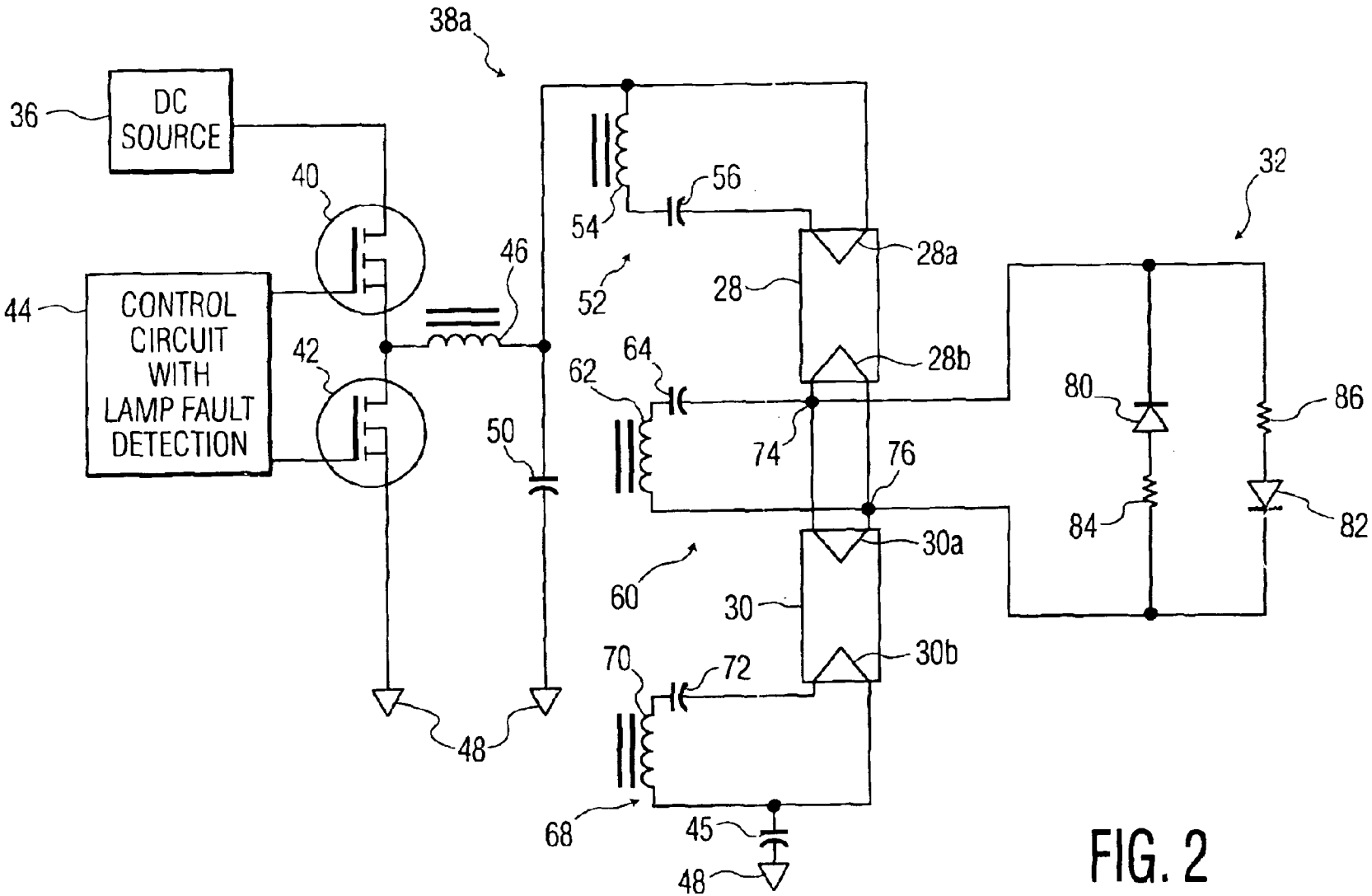
FIG. 2 is a schematic diagram, partially in block form, of a ballast circuit for powering two lamps and including an on-off indicator circuit in accordance with one embodiment of the invention.

FIG. 2 shows a typical arrangement that can be used in accordance with the invention for ballasting a pair of UV lamps 28 and 30, while providing an on-off lamp indicator circuit 32 that emits light when the lamps are operating and that stops emitting light when the lamps stop operating. More broadly, lamps 28 and 30 could comprise other low pressure discharge lamps, such as fluorescent lamps. Lamps 28 and 30 may each have electrodes in the form of filaments 28*a*, 28*b* and 30*a*, 30*b*, respectively. Current flow through the filaments, discussed below, heats the filaments to maintain a desirably elevated temperature for operation.

For powering lamps 28 and 30, a DC source 36, such as rectified AC current from power mains, supplies current to a load circuit 38*a* through a switching arrangement including field-effect transistors (FETs) 40 and 42, which are controlled by a control circuit 44. Control circuit 44 may be of the type described in U.S. Pat. No. 6,366,032, entitled "Fluorescent Lamp Ballast Using Integrated Circuit," by Allison and Moore, which is incorporated herein in its entirety.

Control circuit 44 causes FETs 40 and 42 to alternately conduct; that is, in a manner in which upper FET 40 first conducts while the lower FET 42 is off, providing current flow from DC source 36, left to right through an inductor 46; and then lower FET 42 conducts while upper FET 40 is off, causing current flow from right to left through inductor 46 to a reference or ground 48. Accordingly, current flow in inductor 46 alternates direction in synchrony with the alternate periods of conduction of FETs 40 and 42. The current flow in load circuit 38*a* is thus AC current. Meanwhile, a DC blocking capacitor 45 prevents DC current flow through the lamps.

Other ballasting circuits with two FETs comparable to FETs 40 and 42 or with other switching means will be apparent to those of ordinary skill in the art from the present specification.

To set a resonant frequency of operation of current in load circuit 38*a*, a resonant capacitor 50 cooperates with a resonant inductor 46. A current-supply circuit 52 supplies current for filament 28*a* of lamp 28. Circuit 52 includes an inductor winding 54 coupled to inductor 46, for instance, to receive energy from that inductor. Thus, current in inductor 46 induces current in inductor winding 54, which flows through filament 28*a*. Since filament 28*a* is resistive, current flowing through it heats the filament. A capacitor 56 limits the current in filament 28*a*, and assures that there is no net DC current flow in current-supply circuit 52.

A similar current-supply circuit 60 supplies current to filament 28*b* of lamp 28 and also to filament 30*a* of lamp 30. Circuit 60 includes an inductor winding 60 coupled to receive energy from inductor 46, and a capacitor 64 for limiting current in filaments 28*b* and 30*a* while assuring that there is no net DC current flow in current-supply circuit 60.

Another current-supply circuit 68 supplies current to filament 30*b* of lamp 30. Circuit 68 includes an inductor winding 70 coupled to receive energy from inductor 46, and further includes a capacitor 72 for limiting current in filament 30*b* while assuring that there is no net DC current flow in current-supply circuit 68.

In accordance with the invention, on-off lamp indicator circuit 32 is coupled to receive energy from current-supply circuit 60. For instance, circuit 32 may be coupled to a pair of nodes 74 and 76, across which the voltage of filament 28*b* (and of parallel-connected filament 30*a*) is present. Circuit 32 in the version shown includes diodes 80 and 82, poled in the opposite direction, and coupled together in anti-parallel fashion. One or both of the diodes comprise an LED. A resistor 84 limits the current through diode 80 if such diode 80 comprises an LED, and another resistor 86 limits current in diode 82 if such diode 82 comprises an LED. If diode 80 is not an LED, associated resistor 84 may be omitted; and if diode 82 is not an LED, associated resistor 86 may be omitted.

As used herein, "coupling" of diodes 80 and 82 in anti-parallel fashion allows other devices (e.g., resistors 84 and 86) to be included so long as they do not significantly detract from the indication of whether a lamp is on or off by whichever of diodes 80 or 82 is an LED.

The use of two diodes 80 and 82 allows current to flow first through one diode and then through another. In this way, whichever diode(s) is an LED will provide light when the ballast or driver circuitry (e.g., DC source 36, FETs 40 and 42, and control circuit 44) supplies current to lamps 28 and 30, and will stop providing light when the ballast or driver circuitry stops supplying current to the lamps. The light from one or both of diodes 80 and 82 indicates that the lamps are operating, and the cessation of such light indicates that the lamps are off.

As is conventional, control circuit 44 additionally includes circuitry for sensing a fault condition of the lamps. The fault condition preferably comprises the condition that the load current has ceased. As disclosed in U.S. Pat. No. 6,366,032 by Allison and Moore, the fault conditions that a control circuit may sense include, by way of example, lamp current not reaching a level, for instance, of 50% of normal current within, for instance, 6 seconds.

Figure 3:
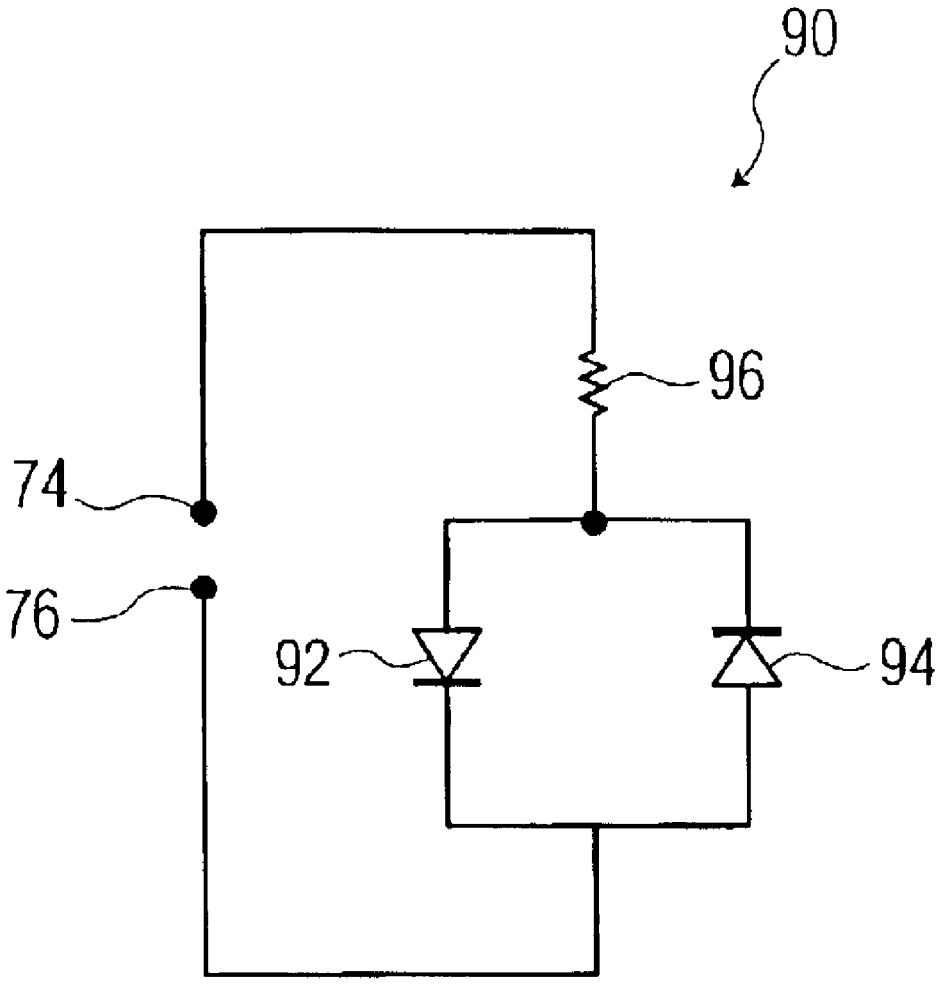
FIG. 3 is a schematic diagram of an alternative on-off indicator circuit that can be used in the circuit of FIG. 2.

On-off lamp indicator circuit 32 may be realized in other forms. For, instance, as shown in FIG. 3, an alternative on-off lamp indicator circuit 90 may include anti-parallel coupled diodes 92 and 94, at least one of which is an LED. Circuit 90 can replace circuit 32 of FIG. 2 at the pair of nodes 74 and 76. An impedance 96 limits current in diodes 92 and 94, and may be resistive, inductive, or capacitive. A resistive impedance 96 can be used with the circuit of FIG. 1. A possible circuit that could use capacitive or inductive impedance is described below.

Rather than using the resistor 84 or 86 shown in the on-off indicator circuit 32 of FIG. 1, or the impedance 96 of the indicator circuit 90 of FIG. 3, other ways of limiting the current in an LED will be apparent to those of ordinary skill in the art in view of the present specification. This also applies to circuits (not shown) using only a single diode, which is possible when DC current is provided for heating lamp filaments.

From the perspective of an LED (e.g., 80 or 82, FIG. 2), circuits for supplying current to filaments of a lamp appear as a constant voltage source. Without some means to limit the current in the diodes, the current in an LED would tend to increase indefinitely and destroy the diodes. So, current-limiting means are used to limit the current in an LED so that the LED can be driven from a constant voltage source.

Thus, in addition to the specific on-off indicator circuits 32 (FIG. 2) and 90 (FIG. 3) shown, three other approaches (not shown) to allow the diodes to be driven by a constant voltage source are as follows. First, more than one diode can be placed in series. Second, a two-transistor (e.g., PNP and NPN bipolar transistors) circuit can be configured to provide two external terminals while supplying essentially constant current regardless of how much driving voltage is impressed. Third, a single bipolar transistor can have its base terminal biased with an essentially constant voltage so as supply essentially constant current from its collector terminal for driving the diodes.

An alternative to using an LED to provide light to indicate the operational state of a lamp is described below.

Figure 4:
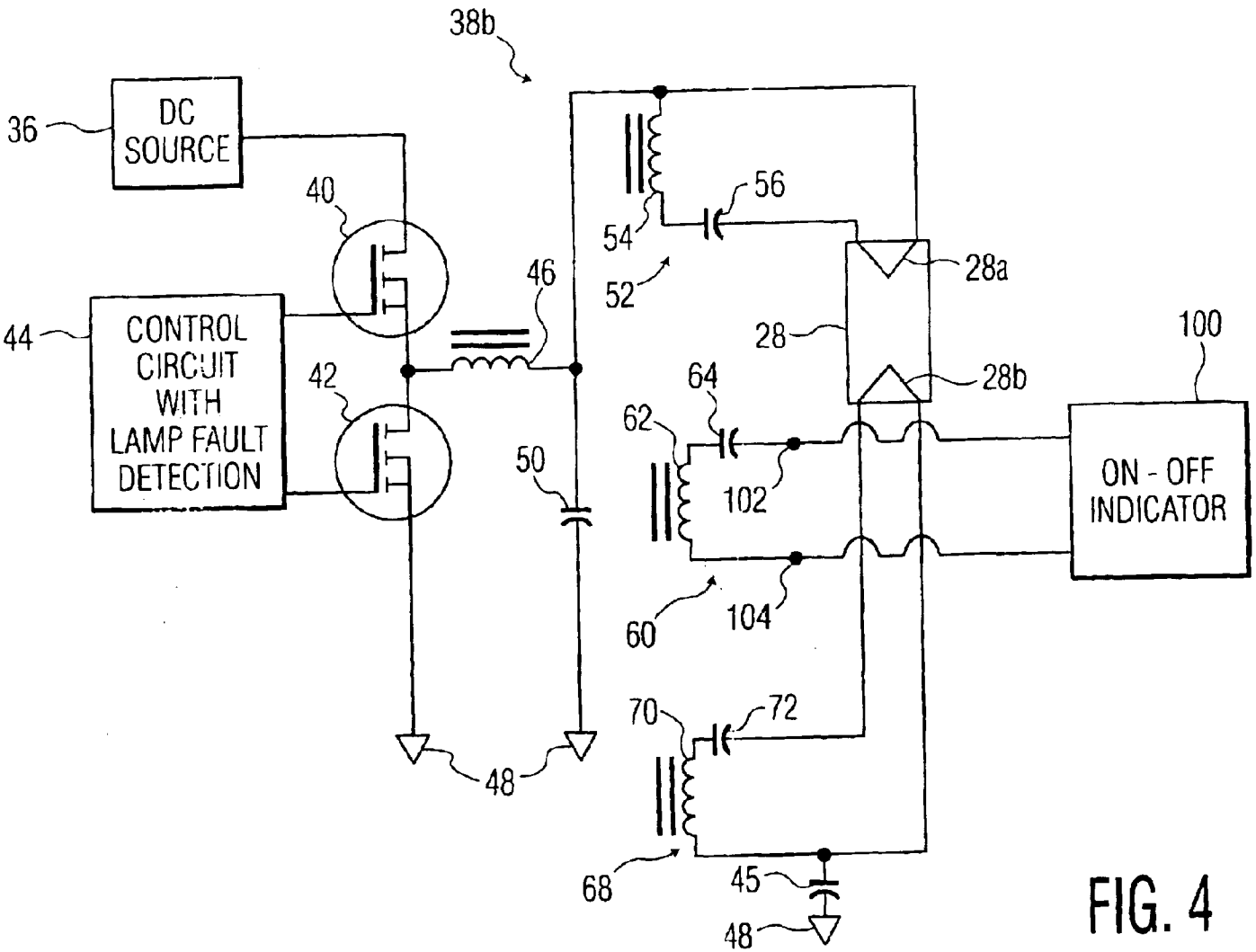
FIG. 4 is a schematic diagram, partially in block form, of another ballast circuit for powering a single lamp and including an on-off indicator circuit in accordance with the invention.

FIG. 4 shows a ballast arrangement similar to that of FIG. 2, but for powering only a single lamp 28 in a load circuit 38*b*. The same reference numerals as between FIGS. 4 and 2 refer to like parts, and so reference is made to the prior description in connection with FIG. 2.

FIG. 4 includes an on-off indicator circuit 100 that may be embodied as shown at 32 in FIG. 2 or at 90 in FIG. 3, for instance. Circuit 100 is coupled to nodes 102 and 104, which are not connected to either filament of lamp 28. Rather, nodes 102 and 104 are coupled to a circuit 60, including inductor winding 62 and capacitor 64, which may normally be designed to supply current to filament 28*b* of lamp 28 and a filament of another lamp (not shown).

On-off indicator circuit 100 may comprise the circuit of FIG. 3. In this case, impedance 96 in FIG. 3 may be inductive or capacitive. Beneficially, impedance 96 may comprise the leakage inductance of inductor winding 62, which would be acceptable since that winding would not be supplying current to a filament of a lamp. Alternatively, since current supply circuit 60 would not be supplying current to a filament of a lamp, a capacitive impedance 96 (FIG. 3) could be used. In this case, moreover, such capacitance can be combined together with the capacitance of capacitor 64 (FIG. 4) so that only a single capacitor is used.

On-off indicator circuit 100 operates in the same manner as described above for the previous on-off indicator circuits. That is, circuit 100 provides light when current flows through the lamp, and ceases to provide light when current stops flowing through the lamp. Current in the lamp, in turn, is controlled by control circuit 44, which shuts off current to the lamp when it senses a lamp fault condition.

Figure 5:
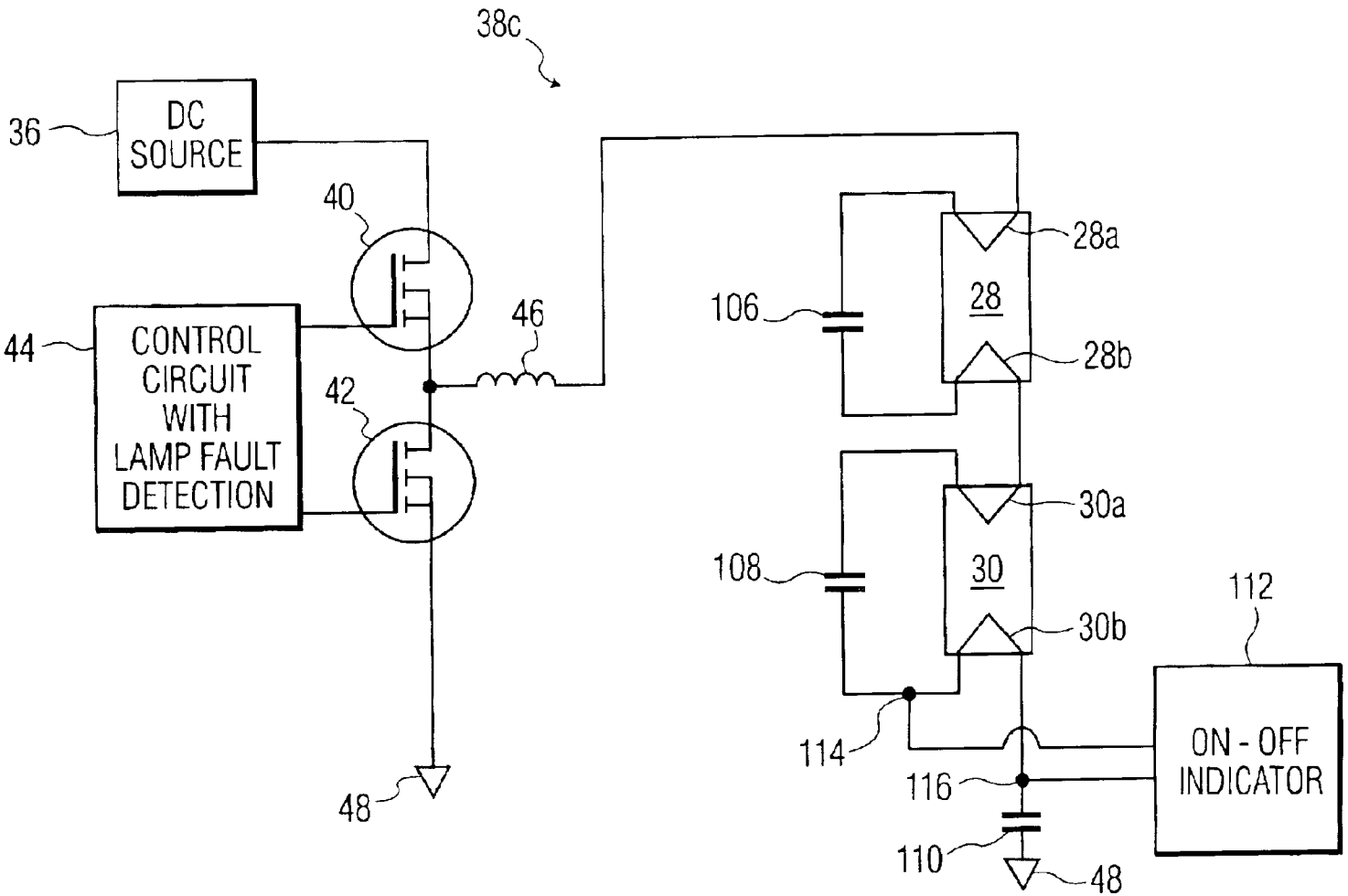
FIG. 5 is a schematic diagram, partially in block form, of another ballast circuit for powering a pair of lamps and including an on-off indicator circuit in accordance with the invention.

FIG. 5 shows a ballast arrangement for powering a pair of lamps 28 and 30 that are included in a load circuit 38*c*. The same reference numerals as between FIGS. 5 and 2 refer to like parts, and so reference is made to the prior description in connection with FIG. 2.

FIG. 5 shows how the principles of the invention may be used with a so-called current-controlled preheat circuit. A single current path passes through the lamp filaments 28*a*, 28*b*, 30*a* and 30*b*, as shown. Capacitors 106 and 108 cooperate with inductor 46 to set a resonant frequency of operation of load circuit 38*c*. Capacitor 110 blocks DC current flow through the lamps.

An on-off indicator circuit 112 may be embodied as shown at 32 in FIG. 2 or at 90 in FIG. 3, for instance. Circuit 112 is connected across nodes 114 and 116, which are connected across filament 30*b* of lamp 30.

On-off indicator circuit 112 operates in the same manner as described above for the previous on-off indicator circuits. That is, circuit 112 provides light when current flows through the lamps, and ceases to provide light when current stops flowing through the lamps. Current in the lamps, in turn, is controlled by control circuit 44, which shuts off current to the lamps when it senses a lamp fault condition.

Figure 6:
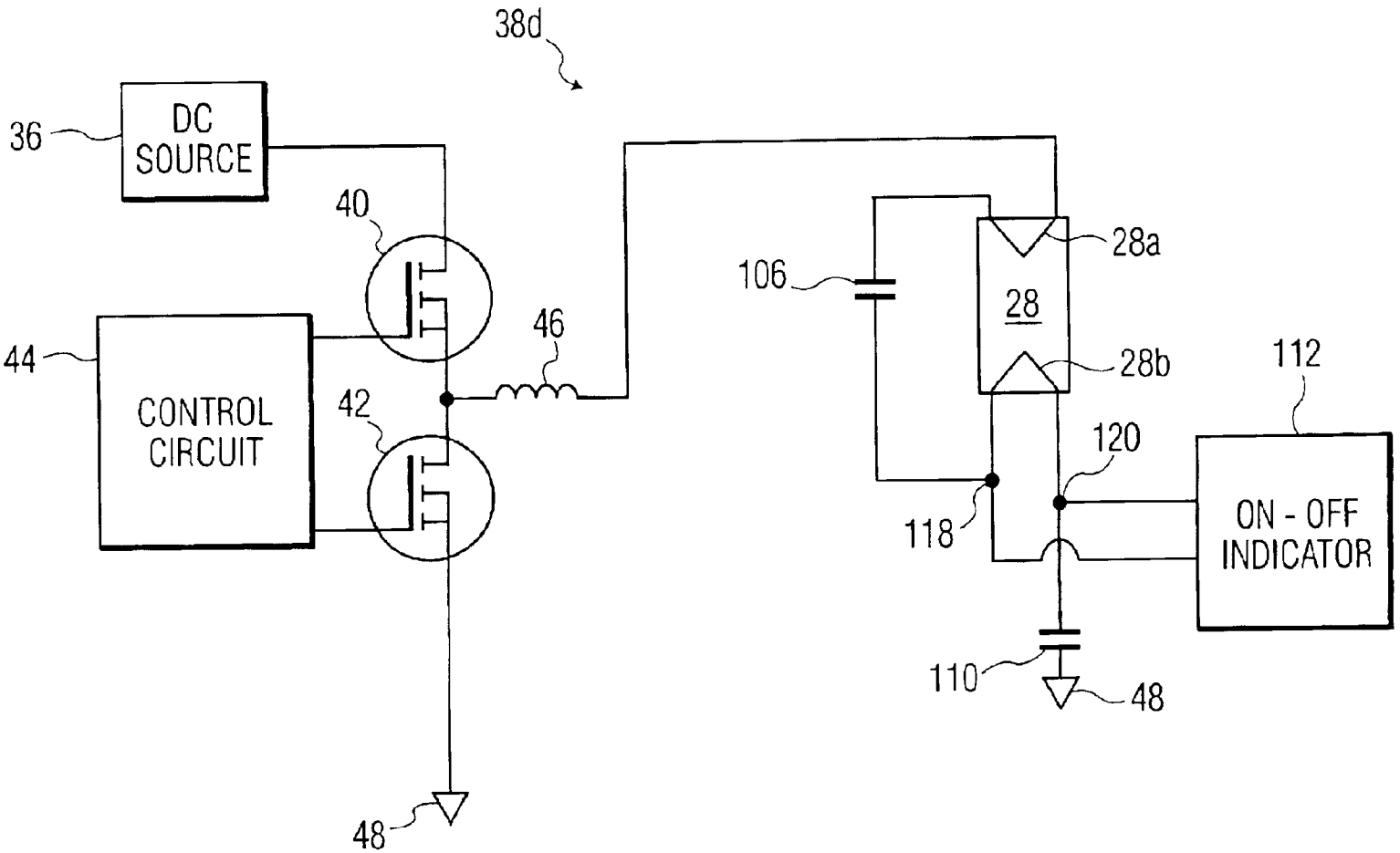
FIG. 6 is a schematic diagram, partially in block form, of ballast circuit similar to that of FIG. 5 for powering a single lamp and including an on-off indicator circuit in accordance with the invention.

FIG. 6 shows a ballast arrangement, similar to that of FIG. 5, but for powering a single lamp 28 in a load circuit 38*d*. The same reference numerals as between FIG. 6 and FIG. 5 or 2 refer to like parts, and so reference is made to the prior description in connection with FIG. 5 or 2.

In FIG. 6, an on-off indicator circuit 112 is connected across nodes 118 and 120, which are, in turn, connected across filament 28*b* of lamp 28. Circuit 112 operates in the same manner as the like-numbered circuit in FIG. 5.

Figure 7:
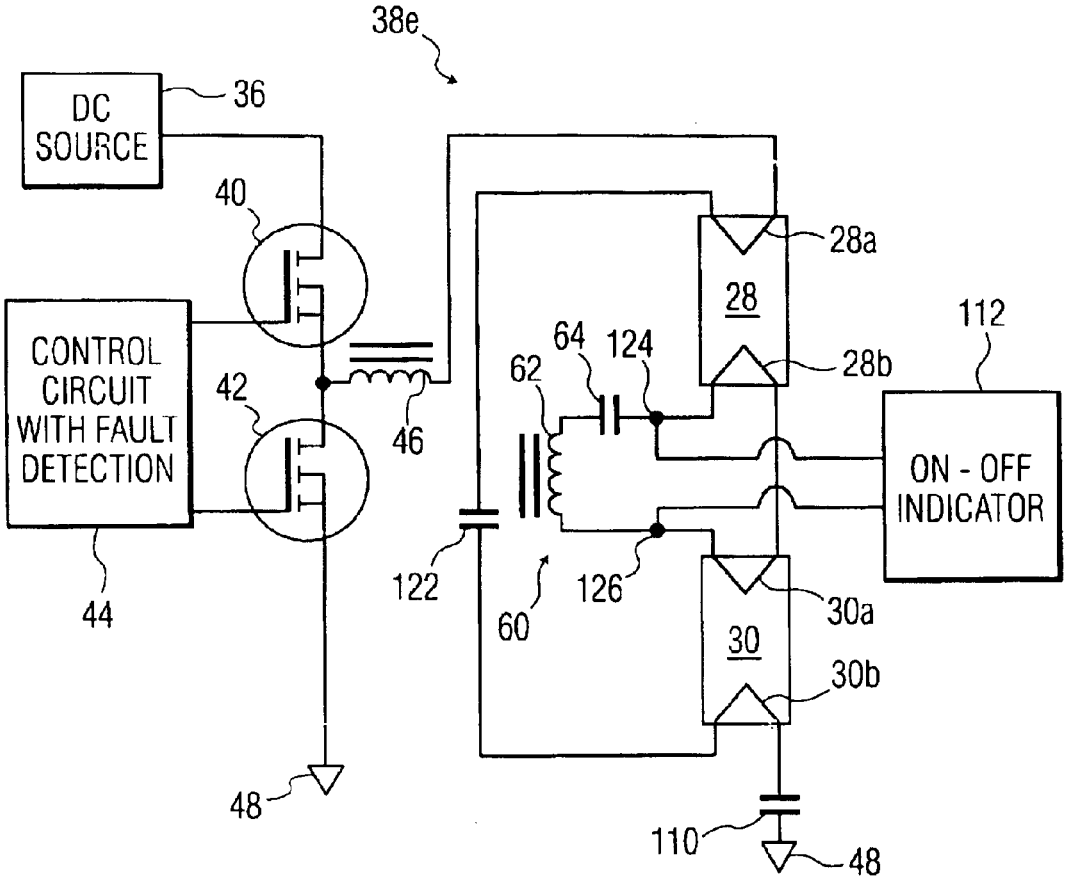
FIG. 7 is a schematic diagram, partially in block form, of another ballast circuit for powering a single lamp and including an on-off indicator circuit in accordance with the invention.

FIG. 7 shows another ballasting arrangement, with similarities to aspects of both FIGS. 5 and 4. The same reference numerals as between FIG. 7 and FIG. 5 or 2 refer to like parts, and so reference is made to the prior description in connection with FIG. 5 or 2.

In FIG. 7, a single current path in load circuit 38*e* passes through only two lamp filaments, that is, filaments 28*a* and 30*b*. A capacitor 122 serves the same function as capacitors 106 and 108 in FIG. 5. As in FIG. 2, inductor winding 62 of circuit 60 is coupled to receive energy from inductor 46, and, in turn, provides current to heat lamp filaments 28*b* and 30*a*. As shown, filaments 28*b* and 30*a* are connected in series. However, an alternative arrangement (not shown) for other types of lamps (e.g. so-called T8 lamps) would be to connect filaments 28*b* and 30*a* in parallel. In either case, on-off indicator circuit 112 would be connected across the pair of nodes (e.g., 124, 126) on which power to drive the filaments is supplied.

On-off indicator circuit 112 is coupled across nodes 124 and 126, which, in turn, are coupled across lamp filaments 28*b* and 30*a*. On-off indicator circuit 112 operates in the same manner as described for the earlier on-off indicator circuits.

Figure 8:
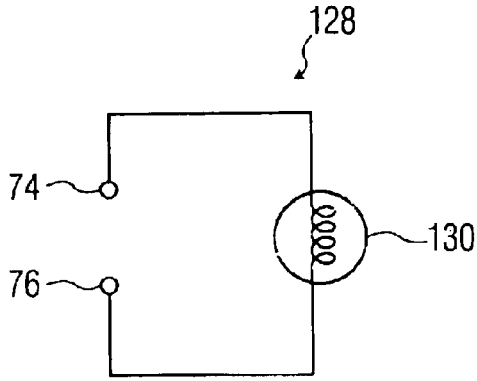
FIG. 8 is a schematic diagram of another form of an on-off indicator circuit in accordance with the invention.

FIG. 8 shows an alternative to using an LED to provide light to indicate the operational state of a lamp. In particular, FIG. 8 shows an on-off indicator circuit 128 comprised of an incandescent lamp 130. Nodes 74 and 76 could be those shown in FIG. 2, for instance, or other similar nodes described herein, such as nodes 102 and 104 in FIG. 4. The typical filament voltage of about 3 volts would be adequate to drive an appropriately chosen incandescent lamp 130. Such a lamp would not require, as in the case of an LED, means to limit the current to the incandescent lamp so that the lamp can be driven by a constant voltage source, since the impedance of the incandescent lamp limits the current.

Exemplary component values for the circuit of FIG. 2 are as follows for UV lamps 28 and 30 each rated at 26-watts, with a voltage from DC source 36 of 470 volts; and with an operating frequency of 48 kHz:

| | |
|---|---|
| Switches 40 & 42 | Type 3NB50, n-channel, enhancement mode MOSFETs, sold by ST Microelectronics, an international company |
| Lamp filaments 28a, 28b, 30a & 30b | 2 ohms each |
| DC blocking capacitor 45 | 0.1 microfarads |
| Resonant inductor 46 | 2.6 millihenries |
| Resonant capacitor 50 | 3.3 nanofarads |
| Capacitors 56, 64 & 72 | 0.1 microfarads each |
| Inductors 54 and 70 | Turns ratio with inductor 46 of 7:230 |
| Inductor 62 | Turns ratio with inductor 46 of 9:230 |
| LEDs 80 and 82 | Part No. 160-1052-ND sold by DigiKey of Thief River Falls, Minnesota |
| Resistors 84 and 86 | 400 ohms each |

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A low pressure gas discharge lamp ballast with on-off indicator, comprising:

a) a load circuit including a low pressure gas discharge lamp;

b) a driver for supplying AC load current to the lamp; the driver including circuitry for shutting off the load current in the presence of a lamp fault condition;

c) a pair of nodes which has voltage across the nodes when the lamp operates normally, and which has substantially no voltage across the nodes when the lamp is off;

d) an on-off indicator circuit including a light-emitting device and being coupled to the pair of nodes for causing the light-emitting device to emit light when the driver supplies load current to the lamp and for causing the light-omitting device to cease to emit light when the driver no longer supplies load current to the lamp; and e) the light-emitting device comprising a first diode, wherein the first diode is a light-emitting diode.

2. The ballast of claim 1, wherein the fault condition comprises the load current being outside of normal parameters.

3. The ballast of claim 2, wherein the fault condition is load current ceasing.

4. The ballast of claim 1, wherein:

a) the pair of nodes is supplied by a constant voltage source from the perspective of the light-emitting diode, and b) the ballast further comprises a means for limiting current through the light-emitting diode to protect the light emitting diode from over-current destruction.

5. The ballast of claim 4, wherein the on-off indicator circuit comprises a second diode coupled in anti-parallel fashion to the light-emitting diode.

6. The ballast of claim 4, wherein the current-limiting means comprises a resistance coupled to the light-emitting diode.

7. The ballast of claim 4, wherein the current-limiting means comprises at least one diode in series with the light-emitting diode.

8. The ballast of claim 5, wherein:

a) the light-emitting diode end the second diode are coupled substantially directly in anti-parallel with each other; and b) the on-off indicator circuit further includes a resistance serially connected to the anti-parallel connected diodes, such resistance functioning as the current-limiting means.

9. The ballast of claim 4, wherein:

a) the light-emitting diode and the second diode are coupled together in anti-parallel fashion between a pair of end nodes;

b) the on-off indicator circuit further includes a first resistance serially connected to the light-emitting diode, between the pair of end nodes, such resistance functioning as the current-limiting means.

10. The ballast of claim 1, wherein the lamp is an ultraviolet lamp.

11. A low pressure ass discharge lamp ballast with on-off indicator, comprising:

a) a load circuit including a first low pressure gas discharge lamp having first and second heated filaments;

b) a driver for supplying AC load current to the lamp; the driver including circuitry for shutting off the load current in the presence of a lamp fault condition;

c) a pair of nodes which has voltage across the nodes when the lamp operates normally, and which has substantially no voltage across the nodes when the lamp is off; and d) an on-off indicator circuit including a light-emitting device and being coupled to the pair of nodes for causing the light-emitting device to emit light when the driver supplies load current to the lamp and for causing the light-omitting device to cease, to emit light when the driver no longer supplies load current to the lamp.

12. A low pressure gas discharge lamb ballast with an on-off indicator, comprising:

a) a load circuit including a first low pressure gas discharge lamp having first and second heated filaments;

b) a driver for supplying AC load current to the lamp; the driver including circuitry for shutting off the load current in the presence of a lamp fault condition;

c) a pair of nodes which has voltage across the nodes when the lamp operates normally and which has substantially no voltage across the nodes when the lamp is off; the pair of nodes have having voltage across the nodes, and an impedance between the nodes, suitable to heat a lamp filament; and d) an on-off indicator circuit including a light-emitting device and being coupled to the pair of nodes for causing the light-emitting device to emit light when the driver supplies load current to the lamp and for causing the light-emitting device to cease to emit light when the driver no longer supplies load current to the lamp.

13. The ballast of claim 11 or 12, further comprising a current-supply circuit for supplying filament current to the first heated filament; the current-supply circuit being coupled to the load circuit for receiving energy for creating the filament current.

14. The ballast of claim 13, wherein:

a) the load circuit comprises a resonant inductor for setting a resonant frequency of operation of the load circuit; and b) the current-supply circuit comprises an inductor winding coupled to the resonant inductor to receive energy from the resonant inductor.

15. The ballast of claim 11 or 12, wherein:

a) the load circuit includes a second low pressure gas discharge lamp having a first heated filament and a second heated filament;

b) the second heated filament of the first low pressure gas discharge lamp is connected in parallel with the first heated filament of the second lamp; and c) the pair of nodes is respectively connected to opposite ends of the second heated filament of the first low pressure gas discharge lamp.

16. The ballast of claim 11 or 12, further comprising:

a) a first current-supply circuit coupled to the load circuit for receiving energy from the load circuit to drive the first heated filament of the first lamp; and b) a second current-supply circuit coupled to the load circuit for receiving energy from the load circuit to drive the second heated filament of the first lamp;

c) the pair of nodes being separate from the first and second current-supply circuits.

17. The ballast of claim 16, wherein the pair of nodes is coupled to the load circuit for receiving sufficient energy to drive more than one lamp filament.

18. The ballast of claim 16, wherein the pair of nodes is free of coupling to a filament of any filament-heated lamp having a heated filament.

19. The ballast of claim 13, wherein the current-supply circuit coincides with the main current path for providing current to the associated first lamp.

20. The ballast of claim 11 or 12, wherein the light-emitting device comprises a first diode, wherein the first diode is a light-emitting diode.

21. The ballast of claim 20, wherein:

a) the pair of nodes is supplied a constant voltage source from the perspective of the light-emitting diode, and b) the ballast further comprises means for limiting current through the light-emitting diode to protect the light-emitting diode from over-current destruction.

22. The ballast of claim 21, wherein the on-off indicator circuit comprises a second diode coupled in anti-parallel fashion to the light-emitting diode.

23. The ballast of claim 21, wherein the current-limiting means comprises a resistance coupled to the light-emitting diode, such resistance functioning as the current-limiting means.

24. The ballast of claim 21, wherein the current-limiting means comprises at least one diode in series with the light-emitting diode, such at least one diode functioning as the current-limiting means.

25. The ballast of claim 21, wherein:

a) the light-emitting diode and the second diode are coupled substantially directly in anti-parallel with each other; and b) the on-off indicator circuit further includes a resistance serially connected to the anti-parallel connected diodes, such resistance functioning as the current-limiting means.

26. The ballast of claim 21, wherein:

a) the light-emitting diode and the second diode are coupled together in anti-parallel fashion between a pair of end nodes;

b) the on-off indicator circuit further includes a resistance serially connected to the light-emitting diode, between the pair of end nodes, such resistance functioning as the current-limiting means.

27. The ballast of claim 11 or 12, wherein the on-off indicator circuit essentially comprises an incandescent lamp.

28. The ballast of claim 11 or 12, wherein the lamp is an ultraviolet lamp.

29. The ballast of claim 28, wherein the voltage across the pair of nodes, and the impedance between the nodes, is suitable to heat a lamp filament.

30. A low pressure gas discharge lamp ballast with on-off indicator, comprising:

a) a load circuit including a low pressure gas discharge lamp;

b) a driver for supplying AC load current to the lamp; the driver including circuitry for shutting off the load current in the presence of a lamp fault condition;

c) a pair of nodes which has voltage across the nodes when the lamp operates normally, and which have has substantially no voltage across the nodes when the lamp is off;

d) an on-off indicator circuit including a light-emitting device and being coupled to the pair of nodes for causing the light-emitting device to emit light when the driver supplies load current to the lamp and for causing the light-emitting device to cease to emit light when the driver no longer supplies load current to the lamp; and e) the light-emitting device essentially comprises an incandescent lamp.

31. The ballast of claim 30, wherein the fault condition comprises the load current being outside of normal parameters.

32. The ballast of claim 30, wherein the fault condition is load current ceasing.

33. The ballast of claim 30, wherein the lamp is an ultraviolet lamp.

* * * * *